US007717700B2

(12) United States Patent
Carroni et al.

(10) Patent No.: US 7,717,700 B2
(45) Date of Patent: May 18, 2010

(54) HYBRID BURNER AND ASSOCIATED OPERATING METHOD

(75) Inventors: Richard Carroni, Niederrohrdorf (CH); Timothy Griffin, Ennetbaden (CH)

(73) Assignee: Alstom Technology Ltd., Baden (CH)

( * ) Notice: Subject to any disclaimer, the term of this patent is extended or adjusted under 35 U.S.C. 154(b) by 501 days.

(21) Appl. No.: 11/066,735

(22) Filed: Feb. 28, 2005

(65) Prior Publication Data

US 2005/0196714 A1 Sep. 8, 2005

Related U.S. Application Data

(63) Continuation of application No. PCT/CH03/00436, filed on Jul. 2, 2003.

(60) Provisional application No. 60/406,978, filed on Aug. 30, 2002.

(51) Int. Cl.
*F23D 14/02* (2006.01)
*F23C 9/00* (2006.01)

(52) U.S. Cl. ..... 431/7; 431/170; 431/328; 431/284; 431/285; 431/353; 431/350; 60/723; 60/777

(58) Field of Classification Search ..... 431/7, 431/170, 326, 328, 268, 185, 116; 60/776, 60/777, 723
See application file for complete search history.

(56) References Cited

U.S. PATENT DOCUMENTS 3,914,091 A 10/1975 Yamagishi et al.
3,928,961 A * 12/1975 Pfefferle ..... 60/777
4,067,190 A * 1/1978 Hamm et al. ..... 60/723
4,534,165 A * 8/1985 Davis et al. ..... 60/778
4,870,824 A * 10/1989 Young et al. ..... 431/328
5,235,804 A * 8/1993 Colket et al. ..... 60/780
5,431,017 A 7/1995 Kobayashi et al.
5,569,020 A 10/1996 Griffin et al.
5,713,206 A * 2/1998 McWhirter et al. ..... 60/747
5,729,967 A * 3/1998 Joos et al. ..... 60/723
5,885,068 A * 3/1999 Dobbeling et al. ..... 431/116
5,950,434 A * 9/1999 Hums et al. ..... 60/723
6,126,439 A 10/2000 Knopfel et al.
6,334,769 B1 * 1/2002 Retallick et al. ..... 431/7
6,355,093 B1 * 3/2002 Schwartz et al. ..... 95/56
6,358,040 B1 3/2002 Pfefferle et al.
6,609,905 B2 8/2003 Eroglu et al.
6,638,055 B2 10/2003 Carroni et al.
6,981,865 B2 * 1/2006 Kobayashi ..... 431/7

FOREIGN PATENT DOCUMENTS

DE 77 04 389 A1 8/1995
EP 0 304 707 A1 * 3/1989
EP 0 491 481 A1 * 6/1992

(Continued)

*Primary Examiner*—Carl D Price
(74) *Attorney, Agent, or Firm*—Buchanan Ingersoll & Rooney PC

(57) ABSTRACT

The present invention relates to a hybrid burner (1) for a combustor (7), in particular of a power plant, comprising a housing (2), in which a full oxidation catalyst (9) and a partial oxidation catalyst (10) are arranged. An inlet side of the housing (2) is connected to at least one oxidizer supply (3) and to at least one fuel supply (4, 5). An outlet side of the housing (2) is connected to a combustion chamber (7).

25 Claims, 3 Drawing Sheets

FOREIGN PATENT DOCUMENTS

| | | | | |
|---|---|---|---|---|
| EP | 0 620 402 | A1 | | 10/1994 |
| EP | 0 710 797 | B1 | | 5/1996 |
| EP | 0 767 345 | A2 | | 4/1997 |
| EP | 0 849 451 | A2 | | 6/1998 |
| JP | 55031257 | A | * | 3/1980 |
| JP | 61-276627 | | | 12/1986 |
| WO | 96/41991 | | | 12/1996 |

* cited by examiner

HYBRID BURNER AND ASSOCIATED OPERATING METHOD

RELATED APPLICATIONS

This application claims priorities under 35 U.S.C. §119 to U.S. Provisional Application No. 60/406,978 filed Aug. 30, 2002, and as a Continuation Application Under 35 U.S.C. §120 to PCT Application No. PCT/CH03/00436 filed as an International Application on Jul. 2, 2003 designating the U.S., the entire contents of which are hereby incorporated by reference in their entireties.

FIELD OF THE INVENTION

The invention relates to a hybrid burner for a combustor, in particular of a power plant. Moreover, the invention relates to a method for operating a hybrid burner of this type.

DISCUSSION OF BACKGROUND

It is fundamentally known from EP 0 767 345 A2 to use a hydrogen generator to generate a hydrogen-containing gas from a fuel-oxidizer mixture and to admix this hydrogen-containing gas with a fuel-oxidizer mixture. The hydrogen increases the reactivity of the fuel-oxidizer mixture, enabling the combustion in a catalytic burner stage to be improved. The hydrogen generator used fractionates the associated fuel and thereby generates the hydrogen, preferably with the aid of a catalyst.

EP 0 849 451 A2 has disclosed a method for stabilizing combustion, in which a standard premix burner is supplied with a fuel-oxidizer mixture and the ignited mixture is introduced into a combustion chamber of a combustor for complete combustion. In parallel with this, another fuel-oxidizer mixture is fed to a catalyst, which generates a hydrogen-containing flue gas. This hydrogen-containing flue gas is then injected directly into the combustion chamber, specifically into zones which are particularly suitable for flame stabilizing.

U.S. Pat. No. 6,358,040 B1 shows a method in which a hydrogen-containing flue gas can be generated from a rich fuel-oxidizer mixture by means of a catalyst. This hydrogen-containing flue gas is diluted with preheated oxidizer to such an extent that a lean fuel-oxidizer mixture is formed, which is completely burnt in a subsequent burner stage.

EP 0 710 797 B1 shows a premix burner with a lance arranged in its head. This lance includes a catalyst at its exit end.

SUMMARY OF THE INVENTION

The invention as characterized in the claims deals with the problem of providing an improved embodiment of a burner and an associated operating method. In particular, it is intended to show a way of combining a relatively low-emission catalytic combustion with chemical flame stabilization in the combustion chamber of a burner of this type.

According to the invention, this problem is solved by the subject matters of the independent claims. Advantageous embodiments form the subject matter of the dependent claims.

The invention is based on the general idea of designing the burner as a hybrid burner by the burner comprising firstly a full oxidation catalyst and secondly a partial oxidation catalyst, which are accommodated in a common housing, in such a way that medium can flow through them in parallel. In the present context, a partial oxidation catalyst is to be understood as meaning a catalyst which is configured such that in a rich fuel-oxidizer mixture which is supplied, it does not completely oxidize at least a proportion of the fuel to form $CO_2$ and $H_2O$, but rather oxidizes this proportion only partially, i.e. in part to form $H_2$ and CO. It will be clear that another proportion of the fuel can also be completely converted. In general, the only partially converted proportion of the fuel should form a clear majority at the partial oxidation catalyst. A partial oxidation catalyst uses rhodium, for example. By contrast, the full oxidation catalyst is configured in such a way that generally the majority of the fuel in a lean fuel-oxidizer mixture which is supplied is completely oxidized or converted into $CO_2$ and $H_2O$. A full oxidation catalyst uses palladium, for example.

On account of this design, it is possible in particular to feed a rich fuel-oxidizer mixture, which can be partially oxidized at relatively low temperatures, to the partial oxidation catalyst. This partial oxidation generates heat, which can be used to heat the full oxidation catalyst, so that there too the ignition temperature for a lean fuel-oxidizer mixture can be reached relatively quickly. The catalytic combustion in the hybrid burner according to the invention can therefore be started relatively easily and proceeds in a comparatively stable way.

It is expedient for the partial oxidation catalyst to be designed in such a way, for example as a lance or in a lance, that it introduces its flue gases into a central recirculation zone which is formed in the combustion chamber. If the partial oxidation catalyst is supplied with a rich fuel-oxidizer mixture, its flue gas also has an excess of fuel, so that the injection or introduction of this rich flue gas into the recirculation zone leads to chemical flame stabilizing. This effect can be boosted considerably if the partial oxidation catalyst is designed in such a way that it generates a hydrogen-containing flue gas.

An embodiment of the invention in which, during a starting procedure for starting the hybrid burner, the fuel content of the volumetric flows of the fuel-oxidizer mixtures passed through the catalysts are varied, in such a manner that over the course of the starting procedure the proportion of fuel in the volumetric flow of the first fuel-oxidizer mixture fed to the partial oxidation catalyst decreases, whereas the proportion of fuel in the volumetric flow of the second fuel-oxidizer mixture, fed to the full oxidation catalyst, increases, is of particular interest. This procedure takes account of the fact that the partial oxidation of a rich first fuel-oxidizer mixture in the partial oxidation catalyst starts at lower temperatures and proceeds in a more stable way than the full oxidation of the lean second fuel-oxidizer mixture in the full oxidation catalyst. The partial oxidation which has started can release heat to the full oxidation catalyst, with the result that the latter is quickly heated and accordingly starts the conversion in the second fuel-oxidizer mixture. When the full oxidation catalyst is being run up to its operating point, the release of heat from the partial oxidation catalyst stabilizes the combustion reaction.

It will be clear when using this procedure that it is not possible to reduce the proportion of fuel in the volumetric flow of the rich first fuel-oxidizer mixture fed to the partial oxidation catalyst to any desired extent, since otherwise the fuel-oxidizer ratio $\lambda$ would become too high, resulting in overheating. The partial oxidation catalyst serves as a pilot and may be permanently active, for example at a $\lambda=0.5$. Alternatively, the partial oxidation catalyst pilot can be deactivated, which requires the supply of oxidizer to be stopped before the supply of fuel is switched off; it is in principle possible to carry out a purge with an inert gas, e.g. $N_2$.

It is preferable for the proportions of fuel in the volumetric flows of the fuel-oxidizer mixtures to be varied during the starting procedure as a function of an inlet temperature of the hybrid burner.

Further important features and advantages of the present invention will emerge from the subclaims, from the drawing and from the associated description of figures with reference to the drawing.

BRIEF DESCRIPTION OF THE DRAWINGS

Preferred exemplary embodiments of the invention are illustrated in the drawings and explained in more detail in the description which follows, in which identical designations relate to identical or similar or functionally equivalent components.

In the drawings, in each case schematically.

WAYS OF CARRYING OUT THE INVENTION

Figure 1:
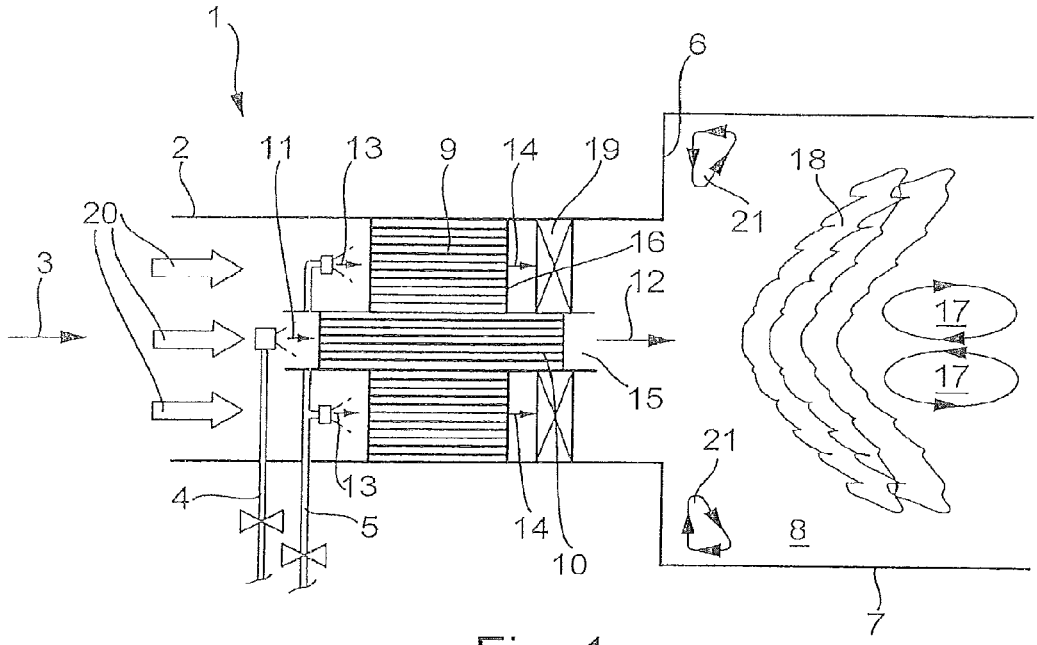
FIGS. 1 to 5 in each case show a greatly simplified longitudinal section through a hybrid burner according to the invention, but in the form of different embodiments.

According to FIG. 1, a hybrid burner 1 according to the invention has a housing 2, which on the inlet side is connected to an oxidizer supply 3 symbolized by an arrow and to two separately controllable fuel supplies 4 and 5. In this case, the fuel used is generally natural gas, although other fuels are in principle also possible. At its outlet, the housing 2 is connected, via a sudden cross-sectional widening 6, to a combustor 7 which includes a combustion chamber 8. It is expedient for the combustor 7 to feed the hot flue gases generated with the aid of the hybrid burner 1 to a gas turbine of a power plant.

According to the invention, the hybrid burner 1 has a full oxidation catalyst 9 and a partial oxidation catalyst 10, both of which are arranged in the housing 2, in such a manner that medium can flow through them in parallel. The partial oxidation catalyst 10 is configured in such a way that when a supplied first fuel-oxidizer mixture 11, symbolized by an arrow, flows through it, it carries out only a partial oxidation of the fuel, at least if the mixture 11 is a rich fuel-oxidizer mixture. It is expedient for the partial oxidation catalyst 10 to be configured in such a way that its flue gas 12, symbolized by an arrow, contains hydrogen. The rich fuel-oxidizer mixture has a fuel/oxidizer ratio of, for example, $\lambda<1$, and preferably of $\lambda<0.5$.

By contrast, the full oxidation catalyst 9 is designed in such a way that it substantially completely oxidizes a supplied second fuel-oxidizer mixture 13 which flows through it and is symbolized by arrows, at least if the mixture 13 is a lean fuel-oxidizer mixture, with its flue gas 14, symbolized by arrows, having an excess of oxidizer. The lean fuel-oxidizer mixture has a fuel/oxidizer ratio of, for example, $\lambda>1$ and in particular of $\lambda>2$.

The two catalysts 9, 10 are expediently coupled to one another in such a manner as to exchange heat. In the specific embodiment shown here, the full oxidation catalyst 9 is arranged in the form of a ring coaxially surrounding the centrally disposed partial oxidation catalyst 10. The catalysts 9, 10 may in this case each have a cylindrical external contour. It is expedient for each catalyst 9, 10 to comprise a catalyst body which includes a multiplicity of passages through which medium can flow in parallel and the walls of which are catalytically active.

The centrally disposed partial oxidation catalyst 10 is in this case designed as a central lance. Accordingly, an exit end 15 of this lance or of the partial oxidation catalyst 10 is positioned downstream of an exit end 16 of the full oxidation catalyst 9 in the housing 2. In another embodiment, the partial oxidation catalyst 10 may also be configured such that it is shorter than the full oxidation catalyst 9. The exit end of the partial oxidation catalyst 10 then lies upstream of the exit end 16 of the full oxidation catalyst 9. At the same time, it is possible for exit end 15 of the then "empty" lance, as before, to be positioned downstream of the exit end 16 of the full oxidation catalyst 9 in the housing 2.

Configuring the partial oxidation catalyst 10 as a lance simplifies targeted introduction of the flue gases 12 from the partial oxidation catalyst 10 into defined zones within the combustion chamber 8. It is preferable for the partial oxidation catalyst 10 to be configured, for example by means of a suitable orientation of the lance, in such a way that it introduces its flue gas 12 into a central recirculation zone 17, which is formed in the combustion chamber 8. This measure allows the combustion in the recirculation zone 17 to be stabilized more successfully. A stable recirculation zone 17 for its part stabilizes a flame front 18 in the combustion chamber 8. The formation of a recirculation zone 17 of this type is promoted, for example, with the aid of a sudden change in cross section 6. By way of example, the combustor 7 operates with what is known as a vortex breakdown, which involves a vortex generated in the hybrid burner 1 breaking down at the transition to the combustion chamber 8, on account of the cross-sectional widening 6. To generate a vortex of this type, it is possible—as here—for a swirl generator 19 to be arranged in the housing 2 downstream of the full oxidation catalyst 9. It is also possible for a swirl generator of this type to be integrated in the full oxidation catalyst 9 itself. By way of example, this can be realized by a suitable orientation of the passages of the full oxidation catalyst 9. A swirl generator of this type may in principle also be connected downstream of the partial oxidation catalyst 10 or integrated therein.

The introduction or injection of the flue gases 12 from the partial oxidation catalyst 10 in the recirculation zone 17 causes the partial oxidation catalyst 10 to have a type of pilot function for initiating and stabilizing the flame front 18.

If a pilot function of this type is not required, it may be expedient for the flue gases 12 from the partial oxidation catalyst 10 to be mixed as intensively as possible with the flue gases 14 from the full oxidation catalyst 9 before the flue gas mixture formed in this way is fed for homogeneous combustion in the combustion chamber 8. Corresponding mixing may in this case be achieved by means of a suitable mixing device (not shown here).

The hybrid burner 1 according to the invention operates as follows:

A starting procedure is carried out to start the hybrid burner 1. In this procedure, a common oxidizer flow 20, symbolized by arrows, is fed to the two catalysts 9, 10 via the oxidizer supply 3, and this oxidizer flow 20 is distributed between the two catalysts 9, 10 as a function of the cross-sectional areas and flow resistances. The volumetric flow of the oxidizer flow 20 can be kept substantially constant during the starting procedure. The first fuel-oxidizer mixture 11 is generated by a corresponding first volumetric flow of fuel being fed to the partial oxidation catalyst 10 via the first fuel supply 4. The second fuel-oxidizer mixture 13 can be generated in a corresponding way by the second fuel supply 5 feeding a second volumetric flow of fuel to the full oxidation catalyst 9.

During the starting procedure, the volumetric flow ratios in the two fuel-oxidizer mixtures 11, 13, i.e. in each case the ratio of the fuel fraction to the oxidizer fraction in the volumetric flow, are varied. The fuel fraction in the volumetric flow of the first fuel-oxidizer mixture 11 decreases from a maximum value to a minimum value during the starting procedure. This minimum value cannot be set at any desired low level without restriction, since the first fuel-oxidizer mixture 11 needs to remain rich in order to prevent the partial oxidation catalyst 10 from overheating and thereby being destroyed. To switch off the supply of fuel to the partial oxidation catalyst 10, it may be expedient for the system to be diluted with an inert gas, such as for example $N_2$. Alternatively, the partial oxidation catalyst 10, which operates as a pilot, may also remain switched on throughout the entire operation of the hybrid burner 1, i.e. including in normal or rated operation. It is also possible for the supply of oxidizer to be reduced to low levels. By contrast, the proportion of fuel in the volumetric flow of the second fuel-oxidizer mixture 13 increases during the starting procedure from a minimum value, which may even be zero, to a maximum value.

In the embodiment shown here, the volumetric flow ratios in the two fuel-oxidizer mixtures 11, 13 are varied primarily through the individual volumetric flows of fuel, which are fed to the catalysts 9, 10 via the first fuel supply 4 and the second fuel supply 5, being varied. At the same time, when the plant is being run up to its operating conditions, it is also possible to increase the volumetric flow of the oxidizer flow 20, but this affects both fuel-oxidizer mixtures 11, 13. It will be clear that it is in principle also possible to adopt a different procedure in order to vary the volumetric flow ratios in the fuel-oxidizer mixtures 11, 13, for example by using adjustable oxidizer flows with constant fuel flows.

During the starting procedure, the volumetric flows of the fuel-oxidizer mixtures 11, 13 are varied as a function of an inlet temperature of the hybrid burner 1. This inlet temperature is at its lowest level at the beginning of the starting procedure, so that the volumetric flow of the first fuel-oxidizer mixture 11 adopts its maximum value, whereas the volumetric flow of the second fuel-oxidizer mixture 13 is at its minimum value. The first fuel-oxidizer mixture 11 is expediently selected in such a way that a first fuel-oxidizer ratio $\lambda_1$ has a value of less than 1, preferably less than ½, so that a rich fuel-oxidizer mixture 11 is fed to the partial oxidation catalyst 10. In the case of a rich fuel-oxidizer mixture 11 of this type, the catalytic reaction in the partial oxidation catalyst 10 can light off even at a relatively low temperature. This reaction generates heat which the partial oxidation catalyst 10 on the one hand radiates into its surroundings and on the other hand releases to the full oxidation catalyst 10 via thermal coupling. This allows the temperature of the full oxidation catalyst 9 to be raised relatively quickly. At the same time, the inlet temperature of the hybrid burner 1 is correlated with this.

As the temperature rises, the volumetric flow of the second fuel-oxidizer mixture 13 is increased starting from its minimum value. It is expedient for the second fuel-oxidizer mixture 13 to be selected in such a way that there is a second fuel-oxidizer ratio $\lambda_2$, which is greater than 1, expediently even greater than 2, so that a lean fuel-oxidizer mixture 13 is present. A lean fuel-oxidizer mixture 13 of this type has a higher ignition temperature, which is reached relatively quickly on account of the preheating by the partial oxidation catalyst 10, so that the catalytic reaction in the full oxidation catalyst 9 can also be started. This reaction likewise generates heat, which further heats the catalysts 9, 10 and therefore the hybrid burner 1.

As the temperature rises, the proportion of fuel in the volumetric flow ratio of the first fuel-oxidizer mixture 11 is reduced further, whereas the proportion of fuel in the volumetric flow ratio of the second fuel-oxidizer mixture 13 is increased further. At the end of the starting procedure, the proportion of fuel in the volumetric flow ratio of the first fuel-oxidizer mixture 11 has reached its minimum value and the proportion of fuel in the volumetric flow ratio of the second fuel-oxidizer mixture 13 has reached its maximum value. In absolute terms, the first volumetric flow of fuel may initially decrease, as the relative proportion of fuel in the volumetric flow of the first fuel-oxidizer mixture 11 decreases, and then increase again or remain constant, or may remain constant or increase from the outset, since the absolute volumetric flow of oxidizer generally increases as the plant is running up to its operating state.

During this starting procedure, it is necessary to ensure that the first fuel-oxidizer ratio $\lambda_1$ in the first fuel-oxidizer mixture 11 is always <1, in order to prevent the partial oxidation catalyst 10 from overheating. In rated operation, furthermore, the partial oxidation catalyst 10 can be supplied with a rich mixture 11, for example in order to reduce disruptive acoustic pulses by chemical stabilization.

It is expedient for the addition of the fuel in all the operating phases of the hybrid burner 1 to be such that the flue gases 12 from the partial oxidation catalyst 10 and the flue gases 14 from the full oxidation catalyst 9 overall generate a lean flue gas mixture which can burn with low emission levels in the combustion chamber 8.

Figure 2:
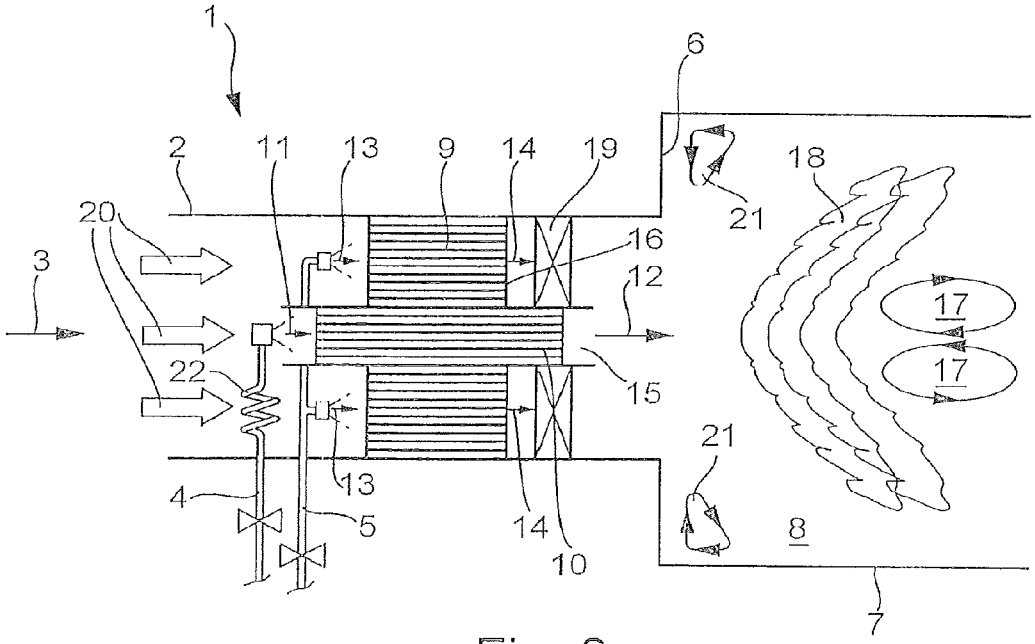
Figure 3:
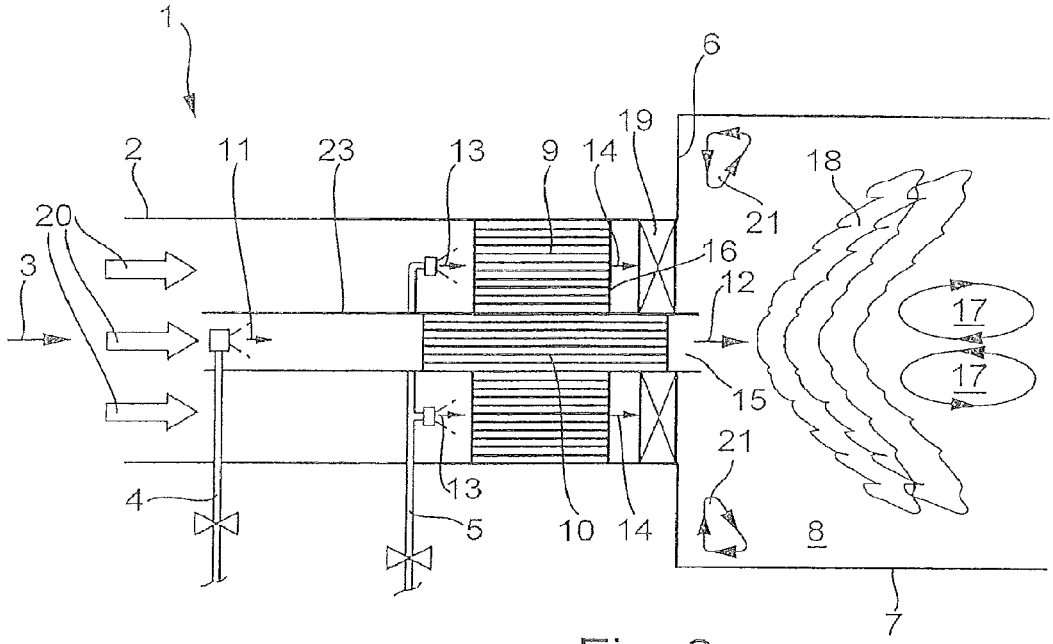

To simplify the spontaneous ignition in the partial oxidation catalyst 10 and to accelerate the running-up of the partial oxidation catalyst 10, it may be expedient to preheat the fuel which is fed to the partial oxidation catalyst 10. For this purpose, the first fuel supply 4 can be configured in such a way that a feed of preheated fuel results for the partial oxidation catalyst 10. FIGS. 2 and 3 show examples of a configuration of the first fuel supply 4 which allow sufficient preheating of the fuel.

In accordance with FIG. 2, the first fuel supply 4 may have a heat exchanger 22. This heat exchanger 22 has firstly a fuel path and secondly an oxidizer path, with the fuel path and oxidizer path being coupled to one another so as to exchange heat. In this way, the oxidizer can release heat to the fuel. In the present example, the heat exchanger 22 is realized by a helical line portion of the first fuel supply 4, which is acted on by the oxidizer flow 20 on its outer side. The fuel path is therefore located in the interior of the helical portion, whereas the oxidizer path is formed by the outer side of the helical portion. It is also possible for the fuel for the partial oxidation catalyst 10 to be preheated in other ways, in particular electrically.

In the embodiment shown in FIG. 3, sufficient preheating of the fuel is achieved by the fuel being introduced into the oxidizer flow 20 relatively far upstream of the partial oxidation catalyst 10, so that the fuel which is introduced, by the time it reaches the inlet of the partial oxidation catalyst 10, has been mixed with the oxidizer to a sufficient extent for temperature balancing between the flows to have occurred. Given a suitable position of the fuel introduction location, it is thereby possible to achieve the desired fuel heating. In the present exemplary embodiment, the partial oxidation catalyst 10 is extended on its entry side by a supply channel 23 running in the opposite direction to the direction of incoming flow, in order to obtain a sufficiently long mixing section for the fuel supplied via the first fuel supply 4 and the oxidizer flow 20. It will be clear that the measures shown by way of example in FIGS. 2 and 3 for preheating the fuel fed to the partial oxidation catalyst 10 may also be combined with one another.

There is also a transfer of heat between the inner entry tube and the outer entry tube.

As has already been explained above, in the embodiments shown in FIGS. 1 to 3 the hybrid burner 1 is configured in such a way that the reactive flue gases 12 from the partial oxidation catalyst 10 can be introduced into the central recirculation zone 17 of the combustor 7.

Figure 4:
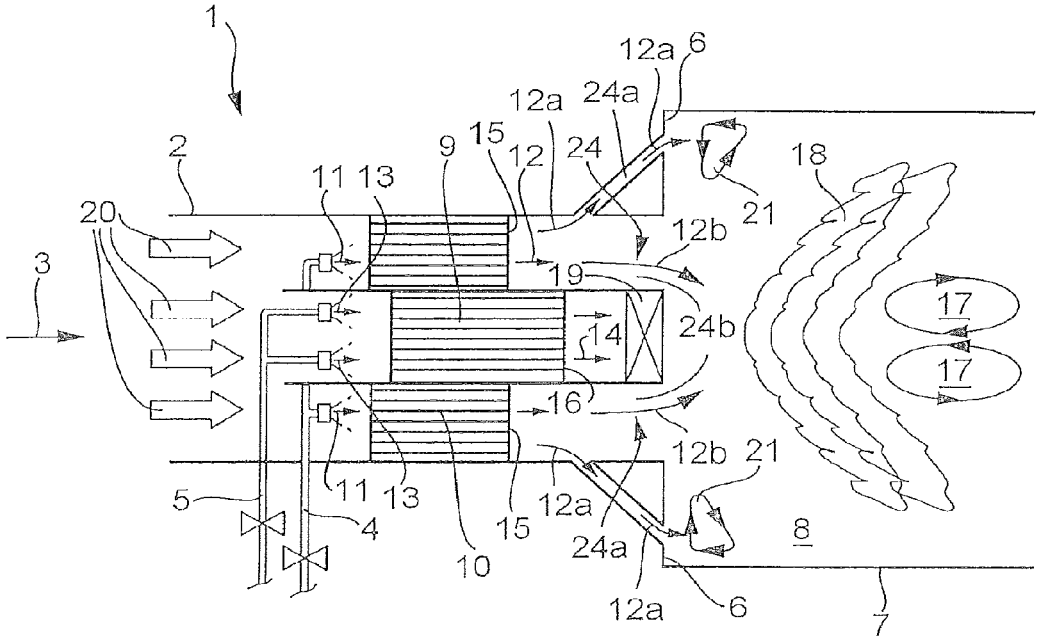
Figure 5:
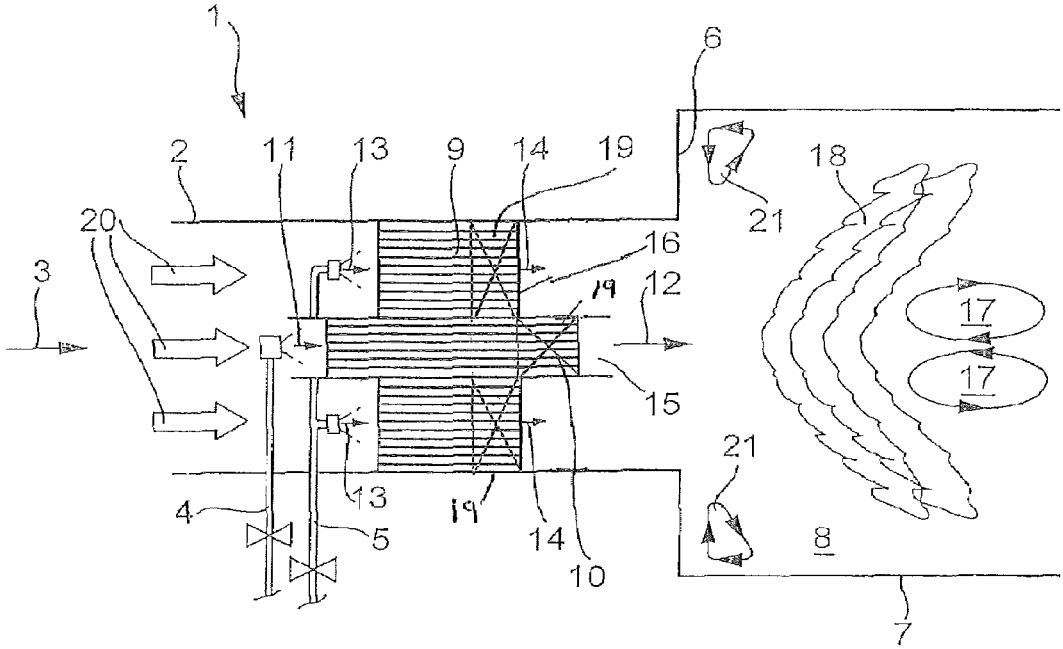

FIG. 4, on the other hand, shows an embodiment in which the hybrid burner 1 is configured in such a way that the flue gases 12 from the partial oxidation catalyst 10 can also be introduced into a lateral recirculation zone 21 which may form in the combustion chamber 8 in the region of the cross-sectional widening 6. The lateral recirculation zone 21 is in this case symbolized by arrows which are intended to represent an annular swirling circulation. The introduction of the reactive flue gases 12 from the partial oxidation catalyst 10 into the lateral recirculation zone 21 allows the combustion reaction to be stabilized in that zone too.

Unlike in the embodiments shown in FIGS. 1 to 3, in the variant shown in FIG. 4 the partial oxidation catalyst 10 is configured in such a way that it surrounds the centrally arranged full oxidation catalyst 9 on the radially outer side, in particular in the shape of a ring. Downstream of the partial oxidation catalyst 10, the housing 12 includes a flue gas path 24, which starts at the exit end 15 of the partial oxidation catalyst 10 and ends at the entry to the combustion chamber 8. The flue gas path 24 includes a main passage 24*b*, which extends substantially axially, i.e. in the main direction of flow. A plurality of secondary passages 24*a*, which lead to the cross-sectional widening 6 and open out into the combustion chamber 8 in the region of the lateral recirculation zone 21, branch off from the main passage 24*b*. In this way, the flue gas 12 from the partial oxidation catalyst 10 can be divided into a main flow 12*b*, which follows the main passage 24*b*, and a secondary flow 12*a*, which flows through the secondary passages 24*a*. Consequently, some of the flue gases 12 from the partial oxidation catalyst 10 can be introduced into the lateral recirculation zone 21. Suitable shaping of the main passage 24*b*, in particular in combination with suitable flow-guide means, allows the main flow 12*b* to be at least partially introduced into the recirculation zone 17.

However, the flue gas 12*b* from the partial oxidation catalyst 10 can in principle be passed to any desired location which appears suitable for a flue gas supply of this nature, in particular the central and lateral recirculation zones 17 and 21.

To prevent overheating of the catalysts 9, 10, in particular in rated operation of the hybrid burner 1, it may be expedient for the respective catalyst 9, 10 to be equipped both with catalytically active passages and with catalytically inactive passages. The catalytically active passages and the catalytically inactive passages are then coupled to one another in such a way as to exchange heat. It is expedient for the passages to be arranged alternately within the respective catalyst structure. In this case, when the hybrid burner 1 is operating, the respective fuel-oxidizer mixture 11 or 13 flows through both the catalytically active passages and the catalytically inactive passages, with the flow of mixture in the catalytically inactive passages cooling the catalytically active passages and therefore the respective catalyst 9, 10. It is of particular interest for catalytically active passages and catalytically inactive passages to be arranged in the full oxidation catalyst 9, since this is responsible for the majority of the conversion of the fuel at the rated operating point of the hybrid burner 1.

LIST OF DESIGNATIONS

1 Hybrid burner
2 Housing
3 Oxidizer supply
4 First fuel supply
5 Second fuel supply
6 Cross-sectional widening
7 Combustor
8 Combustion chamber
9 Full oxidation catalyst
10 Partial oxidation catalyst
11 First fuel-oxidizer mixture
12 Flue gas from 10
13 Second fuel-oxidizer mixture
14 Flue gas from 9
15 Exit end of 10
16 Exit end of 9
17 Recirculation zone
18 Flame front
19 Swirl generator
20 Oxidizer flow
21 Lateral recirculation zone
22 Heat exchanger
23 Supply channel
24 Flue gas path

The invention claimed is:

1. A method for operating a hybrid burner for a combustor, in particular of a power plant, the hybrid burner containing, in a housing, a full oxidation catalyst and a partial oxidation catalyst coupled so as to provide heat exchange between them and, through which medium can flow in parallel, the partial oxidation catalyst being supplied with a first fuel-oxidizer mixture, which has a first fuel-oxidizer ratio, the full oxidation catalyst being supplied with a second fuel-oxidizer mixture, which has a second fuel-oxidizer ratio which is different than the first fuel-oxidizer ratio.

2. The method as claimed in claim 1, wherein the first fuel-oxidizer ratio is less than 1, so that a rich first fuel-oxidizer mixture is present, in that the second fuel-oxidizer ratio is greater than 1, so that a lean second fuel-oxidizer mixture is present.

3. The method as claimed in claim 1, wherein the partial oxidation catalyst is designed in such a way that the partial oxidation catalyst generates a hydrogen-containing first flue gas.

4. The method as claimed in one of claims 1, wherein a first flue gas, generated by the partial oxidation catalyst, is at least partially introduced into a central recirculation zone, which is formed in a combustion chamber of the combustor downstream of the hybrid burner, and/or in that a first flue gas, generated by the partial oxidation catalyst, is at least partially introduced into a lateral recirculation zone, which is formed in the combustion chamber in the region of a sudden cross-sectional widening between hybrid burner and combustion chamber.

5. The method as claimed in claim 1, wherein a first flue gas, generated by the partial oxidation catalyst, is at least partially mixed with a second flue gas, generated by the full oxidation catalyst, before the flue-gas mixture formed in this way is introduced into a combustion chamber of the combustor.

6. The method as claimed in claim 1, wherein, during a starting procedure for starting the hybrid burner, the proportions of fuel in volumetric flows of the fuel-oxidizer mixtures are varied respectively via a first fuel supply control and a second fuel supply control, in such a manner that over the course of the starting procedure the proportion of fuel in a volumetric flow of the first fuel-oxidizer mixture decreases, whereas the proportion of fuel in a volumetric flow of the second fuel-oxidizer mixture increases.

7. The method as claimed in claim 6, wherein during the starting procedure the proportions of fuel in the volumetric flows of the fuel-oxidizer mixtures are varied as a function of an inlet temperature of the hybrid burner.

8. A hybrid burner for a combustor, in particular of a power plant, having a housing, in which a full oxidation catalyst and a partial oxidation catalyst are coupled so as to provide heat exchange between them and arranged such that a medium can flow through them in parallel, and which, in an installed state, the partial oxidation catalyst is connected on an inlet side to at least one oxidizer supply and to a first fuel supply and the full oxidation catalyst is connected on the inlet side to the at least one oxidizer supply and a second fuel supply different from the first fuel supply and the partial oxidation catalyst and the full oxidation catalyst are connected on an outlet side to a combustor.

9. The method as claimed in claim 1, wherein the first fuel-oxidizer ratio is less than 1, so that a rich first fuel-oxidizer mixture is present, in that the second fuel-oxidizer ratio is greater than 2, so that a lean second fuel-oxidizer mixture is present.

10. The method as claimed in claim 1, wherein the first fuel-oxidizer ratio is less than ½, so that a rich first fuel-oxidizer mixture is present, in that the second fuel-oxidizer ratio is greater than 1 so that a lean second fuel-oxidizer mixture is present.

11. The method as claimed in claim 1, wherein the first fuel-oxidizer ratio is less than ½, so that a rich first fuel-oxidizer mixture is present, in that the second fuel-oxidizer ratio is greater than 2, so that a lean second fuel-oxidizer mixture is present.

12. The hybrid burner as claimed in claim 8, further comprising:

a first fuel supply flow control to vary a volumetric flow ratio of a fuel-oxidizer mixture supplied to the full oxidation catalyst; and a second fuel supply flow control to vary a volumetric flow ratio of a fuel-oxidizer mixture supplied to the partial oxidation catalyst.

13. The hybrid burner as claimed in claim 1, wherein a flue gas path is designed in such a way downstream of the partial oxidation catalyst that, when the hybrid burner is operating, it introduces flue gas from the partial oxidation catalyst into a central recirculation zone, which is formed in a combustion chamber of the combustor downstream of the hybrid burner, and/or into a lateral recirculation zone, which is formed in the combustion chamber in the region of a sudden cross-sectional widening between hybrid burner and combustion chamber.

14. The hybrid burner as claimed in claim 8, wherein the partial oxidation catalyst is designed in such a way that when the hybrid burner is operating, the partial oxidation catalyst introduces a flue gas, which emerges at an exit end of the partial oxidation catalyst, into a central recirculation zone, which is formed in a combustion chamber of the combustor downstream of the hybrid burner.

15. The hybrid burner as claimed in claim 8, wherein the partial oxidation catalyst is a central lance, with an exit end of the lance positioned in the housing downstream of an exit end of the full oxidation catalyst.

16. The hybrid burner as claimed in claim 8, wherein the full oxidation catalyst surrounds the partial oxidation catalyst concentrically.

17. The hybrid burner as claimed in claim 8, wherein the partial oxidation catalyst surrounds the full oxidation catalyst concentrically.

18. The hybrid burner as claimed in claim 8, wherein the partial oxidation catalyst is designed in such a way that when the hybrid burner is operating, the partial oxidation catalyst generates a hydrogen-containing flue gas when the partial oxidation catalyst is supplied with a rich fuel-oxidizer mixture.

19. The hybrid burner as claimed in claim 8, wherein the partial oxidation catalyst is designed in such a way that, at least during a starting procedure of the hybrid burner, it releases heat to the full oxidation catalyst.

20. The hybrid burner as claimed in claim 8, wherein the hybrid burner, in an installed state, forms a flue gas path which leads from exit ends of the catalysts, via a sudden cross-sectional widening into a combustion chamber of the combustor.

21. The hybrid burner as claimed in claim 8, wherein at least one swirl generator is arranged in the housing, which swirl generator is arranged downstream of the partial oxidation catalyst and/or the full oxidation catalyst or is integrated in the partial oxidation catalyst and/or in the full oxidation catalyst.

22. The hybrid burner as claimed in claim 8, wherein the first fuel supply introduces fuel upstream of the partial oxidation catalyst into an oxidizer flow fed to the hybrid burner, and the first fuel supply is configured in such a way that preheated fuel is fed to the partial oxidation catalyst.

23. The hybrid burner as claimed in claim 22, wherein the first fuel supply introduces the fuel into the oxidizer flow so far upstream of the partial oxidation catalyst that the fuel is heated through heat exchange with the oxidizer until the partial oxidation catalyst is reached.

24. The hybrid burner as claimed in claim 22, wherein the first fuel supply includes a heat exchanger which is arranged in the oxidizer flow and includes a fuel path and an oxidizer path, which are coupled to one another in such a manner as to exchange heat.

25. The hybrid burner as claimed in claim 8, wherein at least one of the catalysts has catalytically active passages and catalytically inactive passages, which are coupled to one another in such a manner as to exchange heat and, when the hybrid burner is operating, have a fuel-oxidizer mixture, which has been fed to a respective catalyst, flowing through them.

* * * * *

UNITED STATES PATENT AND TRADEMARK OFFICE

CERTIFICATE OF CORRECTION

PATENT NO. : 7,717,700 B2
APPLICATION NO. : 11/066735
DATED : May 18, 2010
INVENTOR(S) : Richard Carroni et al.

It is certified that error appears in the above-identified patent and that said Letters Patent is hereby corrected as shown below:

Column 9, line 40 (claim 13, line 1): change "The hybrid burner as claimed in claim 1" to --The hybrid burner as claimed in claim 8--.

Signed and Sealed this

Thirtieth Day of November, 2010

David J. Kappos

David J. Kappos
*Director of the United States Patent and Trademark Office*